106-99 AU 115 EX
8/3/76 XR 3,972,972

United States Patent [19]

Yano et al.

[11] 3,972,972

[45] Aug. 3, 1976

[54] PROCESS FOR PRODUCING A BOARD OF CEMENT-LIKE MATERIAL REINFORCED BY FIBROUS MATERIAL AND APPARATUS FOR THE PROCESS

[75] Inventors: Tsuyoshi Yano, Tokyo; Takao Take, Mitaka; Kentaro Nakahara, Tokyo; Tetsuro Sasano, Chiba, all of Japan

[73] Assignee: Onoda Cement Company, Ltd., Japan

[22] Filed: Apr. 18, 1974

[21] Appl. No.: 462,176

[30] Foreign Application Priority Data

Apr. 21, 1973 Japan ..... 48-55594

[52] U.S. Cl. ..... 264/117; 106/99; 264/121; 264/122; 264/175; 264/333

[51] Int. Cl.² ..... B28B 1/52

[58] Field of Search ..... 264/121, 122, 117, 175, 264/333; 106/99

[56] References Cited

UNITED STATES PATENTS

| | | | |
|---|---|---|---|
| 2,592,521 | 4/1952 | Thompson | 264/121 X |
| 3,204,019 | 8/1965 | Schulze | 264/122 |
| 3,344,217 | 9/1967 | Mogg et al. | 264/121 |
| 3,770,859 | 11/1973 | Bevan | 264/122 |

*Primary Examiner*—Robert F. White
*Assistant Examiner*—Thomas P. Pavelko
*Attorney, Agent, or Firm*—Wenderoth, Lind & Ponack

[57] ABSTRACT

This invention relates to a process for continuously producing a board of cement-like material reinforced by fibrous material, which comprises (A) preparing granules of cement-like material by adding water to powdery cement-like material; (B) preparing a granular mixture of the cement-like material and fibrous material by mixing the above prepared granules of cement-like material with short lengths of fibrous material dispersed in air; and (C) forming said granular mixture into a board under compression, optionally with the addition of water.

6 Claims, 3 Drawing Figures

CEMENT-LIKE MATERIAL
WATER
FIBROUS MATERIAL
FINAL PRODUCT

PROCESS FOR PRODUCING A BOARD OF CEMENT-LIKE MATERIAL REINFORCED BY FIBROUS MATERIAL AND APPARATUS FOR THE PROCESS

BACKGROUND OF THE INVENTION

This invention relates to a process for producing a stiff board of cement-like material reinforced by fibrous material, having a high density, and to an apparatus for carrying out the process.

Heretofore, a dense stiff board of cement-like material reinforced by fibrous material has been prepared by mixing fibrous material with powdery cement-like material or a slurry of cement-like material with vigorous stirring and forming the mixture into the desired shape by means of various techniques. However, according to the conventional process, in the mixing step, the fibrous material and the powdery cement-like material or the slurry must be stirred mechanically to a great extent, and as a result of this mechanical stirring the fibrous material is damaged. Further according to the conventional process, superfluous water must be removed, but it is difficult to lower the water content of cement cake to a predetermined amount, that is, an amount stoichiometrically required for hydration. The strength of cement-like material after hydration is in inverse proportion to the water content of the cement-like material mixture to be cured. Consequently it is preferred to make the water content of the cement-like mixture as low as possible while still satisfying the amount stoichiometrically required for hydration.

Generally, mixing of a solid with a small amount of liquid or viscous liquid, or mixing of highly viscous liquids is referred to as "kneading". Since very viscous materials require a great deal of energy to mix them together, the operation is more difficult than that of the usual solid mixing or liquid mixing, and therefore it is often carried out with a relatively small apparatus and in a batch-wise system. Consequently, in using the kneading process, fibrous material is badly damaged and it is not satisfactory dispersed. In the kneading process, water isadded while the powdery cement-like material andthe fibrous material are being mixed, but the amount of fibrous material incorporated is restricted to less than 3% and the length of the fibrous material used is also restricted to less than 15 mm.

Various types of mixers or kneading machines can be used for kneading cement-like materials and fibrous materials, but most of them are batch-wise systems and their capacities are relatively small although the power generated by them is large.

In preparing an asbestos-cement plate, a large amount of water is employed to carry out the mixing of the asbestos and cement in a slurry state so that fibers of the asbestos are uniformly dispersed in the cement. However, in such a process, it is necessary to remove superfluous water at a subsequent stage, and it is difficult to prepare a stiff plate having a high density since the water is heldinthe materials. In preparing a gypsum board reinforced by ordinary fibrous material, glass fiber having a maximum fiber length of 10 mm can be incorporated only in an amount of 1%. In the preparation of an asbestos-board, asbestos can be mixed in an amount of 35% at the most, but the maximum fiber length of the asbestos which can be employed is about 5 mm.

As mentioned above, according to the conventional process, it is difficult (a) to uniformly disperse fibrous material in cement-like material; (b) to increase the amount of fibrous material incorporated; (c) to use fibrous material having a long fiber length; (d) to protect the fibrous material from being damaged during kneading; (e) to shorten the kneading time; and (f) to minimize the amount of water.

We have found a novel process for producing a dense stiff board of cement-like material reinforced by fibrous material, which overcomes the above-mentioned difficulties of the conventional process.

SUMMARY OF THE INVENTION

One object of this invention is to provide a process and an apparatus for continuously producing a board of cement-like material reinforced by fibrous material, having a high density, which comprises preparing granules of cement-like material by adding water to powdery cement-like material; preparing a granular mixture of the cement-like material and fibrous material by mixing the above prepared granules of cement-like material with short lengths of fibrous material dispersed in air; and forming said granular mixture into a board under compression, optionally with the addition of water.

Another object and feature of this invention is hereinafter clarified by referring to the accompanying drawings which illustrate an apparatus for carrying out the process of this invention.

DESCRIPTION OF THE PREFERRED EMBODIMENT

Figures 1, 2A, 2B:
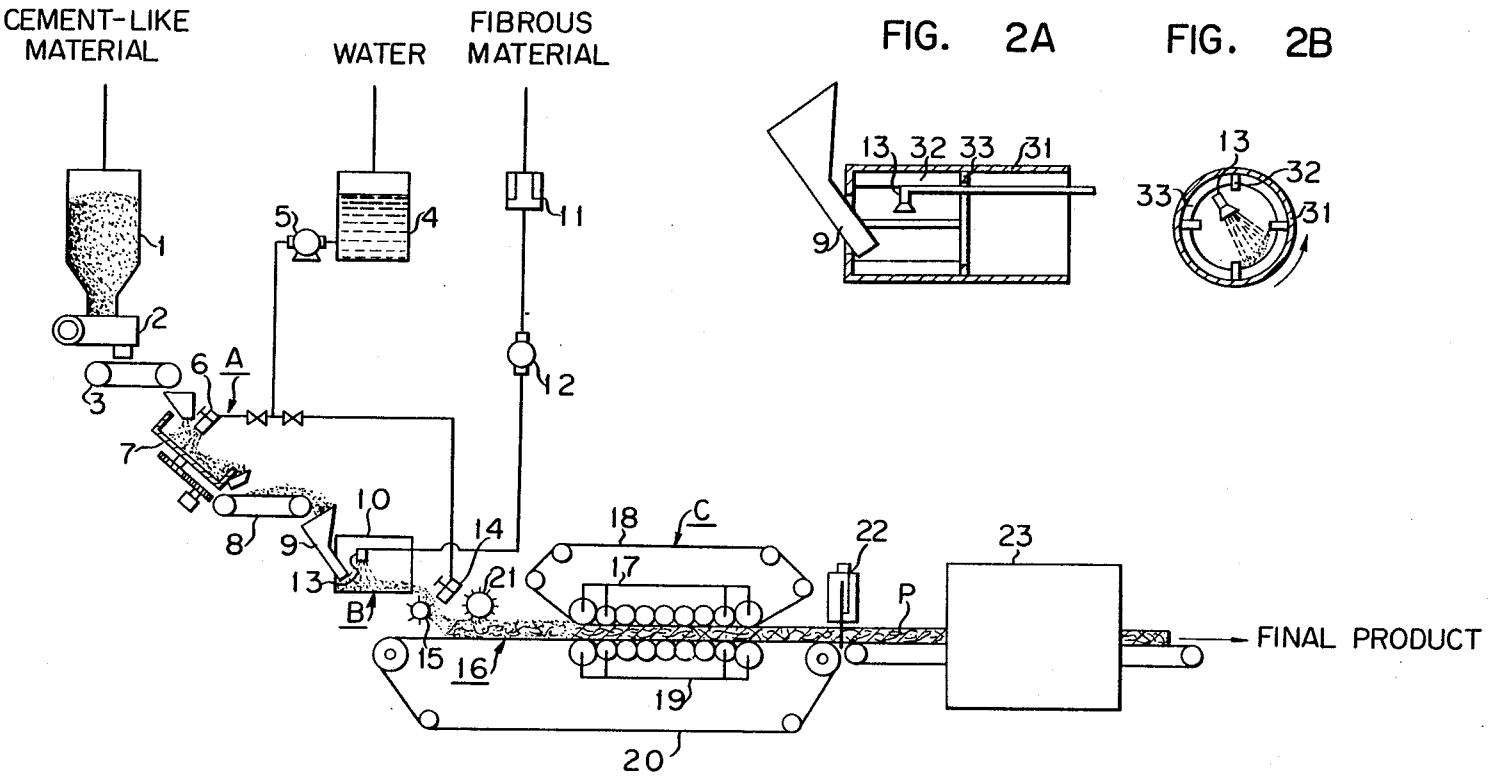
FIG. 1 shows an outline of an apparatus for continuously producing a stiff board having a high density in accordance with the present invention.
FIG. 2A shows a longitudinal sectional view of a mixer employed in the above apparatus.
FIG. 2B shows a cross sectional view of the same mixer as above.

The accompanying drawings illustrate the preferred embodiment of this invention.

The apparatus shown in FIG. 1 comprises part A where granules of cement-like material are prepared; part B where a granular mixture of the cement-like material and fibrous material is prepared by mixing the granules of cement-like material with short lengths of fibrous material dispersed in air; and part C where the granular mixture is formed into a board under compression.

The cement-like material employed in this invention includes cements such as Portland cement, alumina cement, magnesia cement, blast-furnace cement or the like and gypsums such as insoluble anhydrite, calcium sulfate hemihydrate, or the like.

The fibrous material employed in this invention includes glass fiber, vegetable fiber, organic fiber, wood wool, asbestos, rockwool or the like.

In addition to the above basic materials, if necessary, powdery additives such as silica, dolomite, bentonite, fly ash, cement-like material other than the basic material, a swelling agent or the like; granular additives such as aggregate, light weight aggregate or the like; and a setting regulator to control the setting rate may be mixed with the basic materials depending on the use of the final product.

In part A where granules of cement-like material are prepared, powdered cement-like material in tank 1 is forwarded through powder supplier 2 in a fixed quantity, and is conveyed by conveyor belt 3 to pan-shaped pelletizer 7. Water or an aqueous solution in tank 4 is forwarded by pump 5 to the pan-shaped pelletizer 7 where the water or the aqueous solution is sprayed onto the powdered cement-like material by sprayer 6 to prepare granules of cement-like material having a diameter of 1–10 mm. The above prepared granules of cement-like material are then forwarded by conveyor belt 8 and chute 9 to drum-type mixer 10 (part B) where a granular mixture of the cement-like material and fibrous material is prepared.

As can be seen from FIGS. 2A and 2B, the drum-type mixer 10 comprises a cylindrical cell 31 having its rotary axis horizontal lifters 32 disposed at equal distances round the front half of the inside of the cell 31 nearest to chute 9; and stopping ring 33 disposed half way along the inside of the cell 31. Fibrous material such as glass fiber is forwarded through roving 11 and cut into predetermined lengths by roving cutter 12 and then sprinkled through sprinkler 13 onto the granules of cement-like material in the cell 31 of the drum-type mixer 10. Thus, the sprinkled fibrous material is intimately mixed with the granular cement-like material forwarded through the chute 9 into the mixer 10.

The above prepared granular mixture of the cement-like material and the fibrous material is forwarded to press rollers forming machine 16 of part B by impeller 15. The press roller forming machine 16 comprises an upper press roller 17, an upper press belt 18, a lower press roller 19 and a lower press belt 20. The granular mixture of the cement-like material and the fibrous material forwarded by the impeller 15 is formed into a mat having a predetermined thickness by surface-treating roller 21, optionally with the addition of water through sprayer 14, and the mat is formed into a board under compression (for example using a pressure of 50 kg/cm$^2$) by the upper and lower press rollers 17 and 19 when it passes between the upper and lower press belts 18 and 20.

The above prepared board P of cement-like material reinforced by fibrous material is cut into the desired length by cutter 22, and the cut board P is dried and cured to give the final product in curing means 23.

In the apparatus shown in FIG. 1, an inclined pan-shaped pelletizer is employed as a pelletizing machine, but a drum-type rotary system; horizontal or inclined vibrating system; or fluidized or jet stream system pelletizer may optionally be employed.

As a mixer, a drum-type rotary system mixer is employed, but a screw-type mixer or the above mentioned pelletizers may also be employed. However, the drum-type rotary system mixer is particularly preferable since it does not damage the fibrous material.

As a press-forming machine, a press roll system which enables a continuous forming process is employed, but a batch-wise press-molding system may be employed.

As mentioned above, the process of the present invention provides many advantages that fibrous material is uniformly and satisfactorily dispersed in cement-like material thereby effectively achieving reinforcement; that fibrous material is not damaged as much as in conventional processes; that mixing is efficiently carried out using a small power; that various operations such as transportation, measuring and loading into a mold are easy since the mixture is granular; that the forming pressure is satisfactorily conducted to the material to be pressed; and that there is usually no superfluous water to be removed and consequently a stiff board having a high density is produced. In addition to these advantages, in the present invention, fibrous material having a fiber length of more than 100 mm can be used and it can be mixed in an amount of up to 50%. Moreover, it is possible to control the water content to the theoretical minimum amount required for hydration, and to prepare a low water content cement-like mixture having fibrous material well dispersed.

The present invention is further illustrated by the following particular example.

EXAMPLE

Pellets of calcium sulfate hemihydrate having a diameter of 2.5–10 mm were prepared in a pan-shaped pelletizer having a diameter of 1500 mm operated at 48 rpm by adding powdery calcium sulfate hemihydrate to the pelletizer and spraying water over it. The water content employed for preparing the pellets was 25%. The above prepared pellets were conveyed to another pan-shaped pelletizer of the same type where cut glass fiber having a long fiber length was admixed with the calcium sulfate hemihydrate. The above prepared granular mixture of calcium sulfate hemihydrate and glass fiber was then formed into a board under a pressure of 50 kg/cm$^2$ and dried. The process was repeated several times using different lengths of glass fiber.

The board thus prepared was tested to evaluate the dispersion state of the glass fiber.

As a comparative sample, a board was prepared in accordance with the conventional premix process using the same materials.

The results of this test are shown in the following Table.

Table

| Mixing method | Glass fiber (E — glass) Amount mixed (%) | Fiber length (mm) | Evaluation of dispersion | Bending strength (kg/cm$^2$) |
|---|---|---|---|---|
| Process of this invention | 5 | 20 | uniform and satisfactory dispersion | 350 |
| | 5 | 50 | " | 378 |
| | 15 | 20 | " | 534 |
| | 15 | 50 | " | 492 |
| The conventional premix method | 1 | 10 | dispersion of fiber is partial | 140 |
| | 5 | 10 | kneading is impossible | — |

As can be seen from the above, according to this invention, a dense stiff board of cement-like material having fibrous material uniformly dispersed and having an improved bending strength is provided by press-forming a granular mixture of cement-like material and fibrous material having a low water content.

Although the present invention has been described with certain specific embodiments, it is to be understood that modifications and variations may be resorted to without departing from the spirit and scope of this invention as those skilled in the art will readily understand. Such modifications and variations are considered to be within the purview and scope of the present invention.

What we claim is:

1. A process for continuously producing a dense board of cement-like material reinforced by fibrous material, which comprises:

a. preparing granules of cement-like material having a diameter of 1 mm to 10 mm by adding water to a powdery cement-like material in the minimum amount required for granulation;

b. preparing a granular mixture of the cement-like material and fibrous material by means of a pan-shaped pelletizer or a drum-type rotary system mixer by sprinkling fibrous material having a fiber length of 20 mm to 100 mm dispersed in air onto the above prepared granules of cement-like material; and c. forming said granular mixture into a board under compression with the addition of water in such an amount that the total amount of water is the minimum amount theoretically required for hydration.

2. The process according to claim 1, wherein water is added in an amount of 25% in step (a) to prepare said granules of cement-like material.

3. A process according to claim 1, wherein said cement-like material is a member selected from the group consisting of Portland cement, alumina cement, magnesia cement, blast-furnace cement and gypsum.

4. A process according to claim 1, wherein the fibrous material is a member selected from the group consisting of glass fiber, vegetable fiber, organic fiber, wood wool, asbestos and rockwool.

5. The process according to claim 1 wherein the fiber length is between 20 and 50 millimeters.

6. A process according to claim 1 wherein the fiber content is 5 to 15% by weight.

* * * * *